United States Patent [19]

Goldberg

[11] Patent Number: 4,937,998

[45] Date of Patent: Jul. 3, 1990

[54] STRUCTURAL MEMBER

[76] Inventor: Howard Goldberg, 211 Chestnut Ridge Rd., Woodcliff Lake, N.J. 07675

[21] Appl. No.: 208,347

[22] Filed: Jun. 17, 1988

[51] Int. Cl.[5] ..... E04B 5/52

[52] U.S. Cl. ..... 52/729; 52/690; 52/694

[58] Field of Search ..... 52/690–694, 52/364, 639, 695, 729

[56] References Cited

U.S. PATENT DOCUMENTS

| | | | |
|---|---|---|---|
| 991,603 | 5/1911 | Brooks | 52/729 X |
| 2,457,250 | 12/1948 | Macomber | 52/364 X |
| 2,578,465 | 12/1951 | Davis, Jr. et al. | 52/690 X |
| 2,630,890 | 3/1953 | Macomber | 52/694 X |
| 3,164,227 | 1/1965 | Davis, Jr. et al. | 52/364 X |
| 3,221,467 | 12/1965 | Henkels | 52/690 |
| 4,520,609 | 6/1985 | Worley et al. | 52/729 |
| 4,542,615 | 9/1985 | McCall | 52/729 |

*Primary Examiner*—Richard E. Chilcot, Jr.
*Attorney, Agent, or Firm*—Klauber & Jackson

[57] ABSTRACT

A structural member suitable for use as a joist has a web formed from a continuous rod or bar bent and shaped to define a plurality of peaks, and a flange overlying each edge of the web, with each flange formed from a continuous steel sheet bent and folded upon itself to define a socket for reception of the peaks of the web, and the wings of the flange.

6 Claims, 2 Drawing Sheets

STRUCTURAL MEMBER

FIELD OF THE INVENTION

This invention related to metal structural members and is more particularly concerned with metal structural members of novel configuration particularly suitable for use as joists, trusses or girders in residential construction.

BACKGROUND OF THE INVENTION

It has long been known that wooden joists shrink across the grain thus causing the flooring to separate from the shoe strip and the door trim. The shrinking and warping of wooden joists causes plaster cracks and gives rise to sagging uneven floors, and this form of joist, though widely used in expensive as well as in low cost houses, has drawbacks.

Many prior proposals have been made aimed at the substitution of metal joists for the conventional wooden ones, but such metal joists which have been devised to meet the structural requirements of the various building codes, have generally been too expensive to manufacture in competition with wooden joists.

One of the features of metal structural members for residential construction to be used to the exclusion of wooden members, e.g. as joists and the like, is that they be nailable, so that flooring and sub-flooring can be easily secured to them. This has been a problem. Efforts to make the structural members, e.g. joists, nailable have often led to an undesired loss in strength. It is also important, of course, that the structural members be strong and capable of bearing loads and that they be relatively inexpensive.

Nailable metal structural members, e.g. for use as joists, have heretofore been proposed. Typical prior proposals are disclosed, for example, in Davis, et al., U.S. Pat. Nos. 2,578,465, and 3,164,227; in Goodwin, U.S. Pat. No. 2,605,867, and in Macomber, U.S. Pat. No. 2,630,890.

While these prior constructions are effective for their intended purpose, there is a continuing need for improved structures which are more easily and economically formed without sacrifice in strength and utility.

OBJECTS OF THE INVENTION

It is accordingly, an object of the invention to provide a novel and improved metal structural member suitable for use as a screw-fastenable joist and the like in residential construction.

It is another object of the invention to provide a structural member of the character indicated which has desired strength yet can be rapidly and economically formed.

SUMMARY OF THE INVENTION

In accordance with the invention, there is provided a structural member suitable for use as a joist, truss or girder comprising a web formed from a continuous length of metal, such as a rod, bar or the like, which is bent and shaped by roll forming to define a plurality of peaks, and flanges on each edge of the web, each flange being each formed from a continuous metal sheet or strip bent and folded upon itself to define a socket or channel for reception of said peaks of said web, and to provide fastenable surfaces. It is a feature of the invention that the walls of the sockets and the fastenable surfaces are characterized by a double thickness of the metal sheet.

BRIEF DESCRIPTION OF THE DRAWING

Other objects and features of the invention will be apparent from the following detailed description and from the drawing, wherein.

FIG. 3 is a greatly enlarged detailed sectional view of the embodiment shown in FIG. 2 illustrating its association with a supporting surface, such as flooring, a ceiling, or the like.

DESCRIPTION OF THE PREFERRED EMBODIMENT

Figure 1:
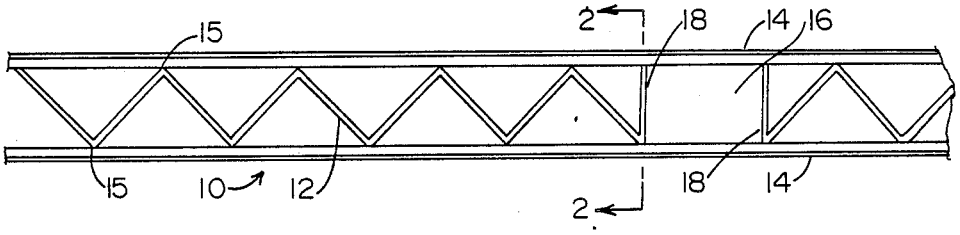
FIG. 1 is an elevation of a structural member embodying features of the present invention.

Referring to FIG. 1, there is shown a structural member 10 in the nature of a joist, embodying features of the present invention. The member 10 has a web 12 and flanges 14 at each edge of the web, i.e. two opposed flanges. In the embodiment illustrated, the web 12 is formed from a continuous rod or bar which is bent by roll forming as illustrated so that it forms a plurality of peaks 15 and extends between the webs 14 at an acute angle except for an area where an opening 16 is left, and the bent rod portions outlining this area 16 extend substantially perpendicularly between the flanges 14, as indicated at 18.

Figure 3:
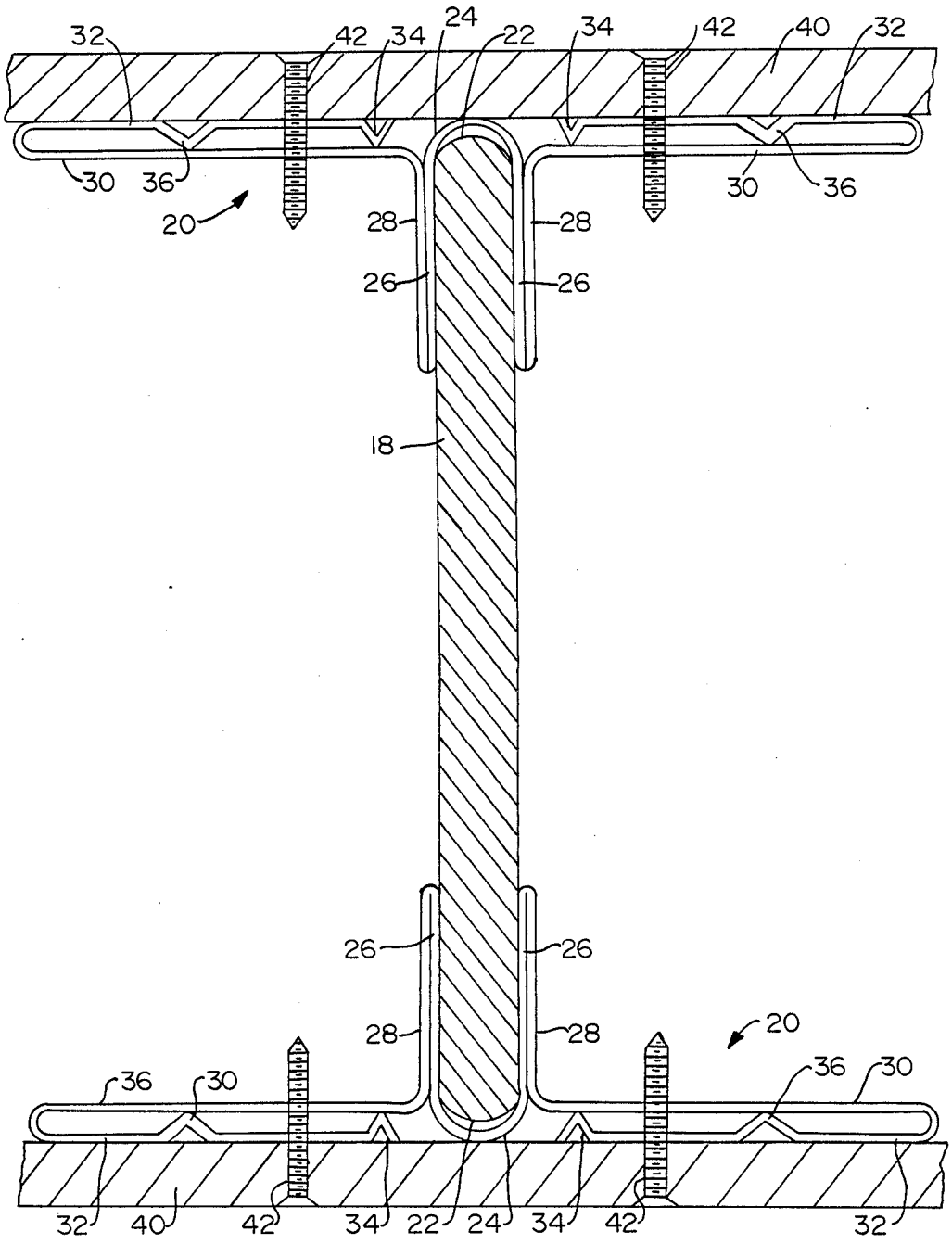
Figure 2:
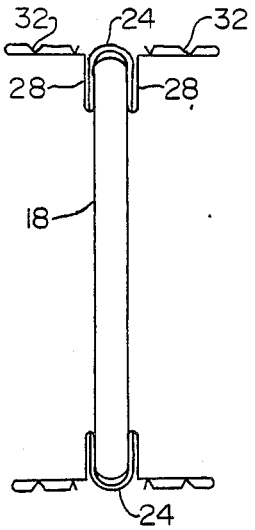
FIG. 2 is a somewhat schematic sectional view of the embodiment of FIG. 1, on an enlarged scale, as taken approximately along the line 2—2 of FIG. 1.

As seen particularly in FIG. 3, each flange is roll formed from a single continuous metal sheet, e.g. a 20-gauge steel sheet, which is bent and folded upon itself in a particular manner, as shown in the drawing. The sheet forming the flange can, however, be of any thickness which can be conveniently bent and folded. Each sheet, indicated generally by the reference 20, is twice folded upon itself adjacent its center to define a socket or channel 22 extending the length of the member 10. It is a feature of the invention that the sockets 22 be formed into their illustrated shapes by rolling the metal sheet. Thus, as illustrated, the sheet 20, when shaped and folded, has a central arcuate rib 24 which merges with sidewalls 26 to define the socket or channel 22. It is a further feature of the invention that the portions of the sheet defining the walls of the socket 22 are retroverted so that the metal sheet is folded upon itself and defines a secondary wall 28 which overlies and effectively reinforces walls 26. The flanges 14 of member 10 can be of any desired size convenient for screw-fastening. Adjacent the top of socket 22, the metal sheet on each side is bent at right angles to define wings 30 of the flange 14 illustrated. The metal at the ends of the wings 30 is retroverted and folded upon itself to define secondary wings 32 which terminate short of the rib 24 but have a retroverted end 34 and are formed with a central depression 36. The retroverted end 34 and the central depression 36 serve to space the secondary wings 32 a slight distance from wings 30 substantially at the level of rib 24, giving them increased strength and fastenability.

Again referring to FIG. 3, when the member 20 is employed as a joist, supporting surfaces 40, e.g., flooring, are readily fastened to it by means of appropriate screws 42, such as conventionally used with metal, and these screws penetrate both the wings and the secondary wings, to give the screws exceptional holding power. Actually, flooring or a ceiling support can be screw-fastened to each flange 14 of a plurality of members 10 and the resulting assembly can be disposed between vertically-superposed walls in constructing a modular building unit, as disclosed in my copending application being filed concurrently herewith and entitled "Prefabricated Building System," the disclosure of which is incorporated herein by reference.

Figure 4:
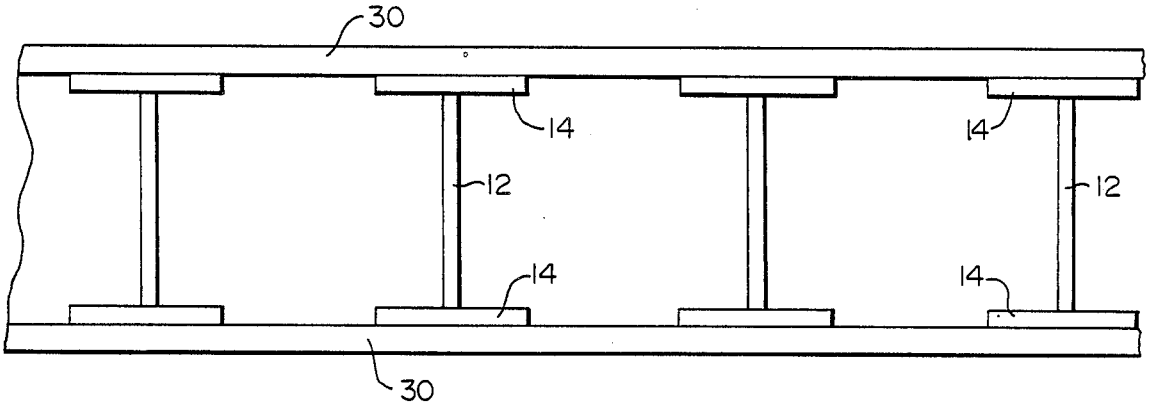
FIG. 4 is a partial elevational view of an assembly of structural members in accordance with the invention and associated supporting surfaces.

Thus, from the foregoing it will be apparent that both flanges can have means providing supporting surfaces 30 nailed to them, e.g. sub-flooring boards, plywood, and the like, as seen in FIG. 3. It is contemplated that a supporting assembly to which the tops or bottoms of the wall panels can be attached can be constructed from a plurality of parallel, spaced-apart joist members 10 to both flanges of which are fastened supporting surface units. Such a unit is shown diagrammatically, in part, in FIG. 4. In the case of a first-floor floor joist, only its top flange would have flooring fastened to it and its lower flange would be secured to a foundation member, rest up a sill, or the like.

In the making of structural member 10, the rod 18 is dimensioned to be snugly received in socket 22, but ordinarily it is advantageous to ensure a firm connection by means of welding, or the like. In the embodiment of FIG. 1, the open area 16 wherein the vertical portions 18 of the rod 12 are interconnected within the socket 22, may be omitted, and the rod 12 may be bent at reverse right angles, as shown at the left of FIG. 1, throughout its length, but it is highly preferred to have the open area 16 available for construction purposes.

As will be apparent from the foregoing description, the structural member 10 of the invention is of relatively uncomplicated construction and is formed from a minimum of pieces; yet it is lightweight, strong, capable of having flooring and the like securely nailed to it, and it is particularly characterized by being easy to manufacture at a relatively low cost. The structural member is characterized by increased strength per unit of steel weight. It will be further apparent that the structural member 10 can be formed of any convenient length and then cut to size as desired, e.g. for use as joists, or the like.

It will be apparent that various changes and modifications may be made without departing from the invention as defined in the appended claims, and it is intended, therefore, that all matter contained in the foregoing description and in the drawing shall be interpreted as illustrative only and not as limitative of the invention.

What is claimed is:

1. A structural member suitable for use as a joist comprising:

paired juxtaposed flanges and connecting web extending therebetween, each of said flanges formed from a continuous metal sheet longitudinally bent and folded upon itself and comprising:

(a) a socket for reception of said web, said socket located substantially at the center of said flange and having walls of double thickness; and (b) paired wings extending from the center of said flange in the same plane and in opposite directions to each other to define screw-fastening surfaces, each of said wings defined by a continuous length of said metal sheet that is retroverted and folded over itself and defining parallel, spaced-apart layers for the support and screw-fastening attachment of other structural surfaces thereto, wherein the layers of each of said wings are discontinuous from each other and connected only by said socket.

2. A structural member as defined in claim 1, wherein said socket is formed by rolling.

3. A structural assembly comprising a plurality of parallel, spaced-apart structural members as defined in claim 1, and means defining a support surface overlying and secured to the flanges of the structural member on at least one side of said assembly.

4. An assembly as defined in claim 3, wherein means defining supporting surfaces overlie and are secured to both flanges of all structural members in the assembly.

5. A structural member as defined in claim 1, wherein each said wing includes at least one central depression defined in the layer of said wing adapted to communicate with said other structural surfaces with which said structural member is to be fastened, said central depression extending from the layer in which it is defined and into proximity to the other spaced apart layer of said wing, to maintain the layers of said wing in said spaced apart relation to each other.

6. A flange for use in a structural member suitable for use as a joist, said flange comprising:

(a) a socket for reception of said web, said socket located substantially at the center of said flange and having walls of double thickness; and (b) paired wings extending from the center of said flange in the same plane and in opposite directions to each other to define screw-fastening surfaces, each of said wings defined by a continuous length of said metal sheet that is retroverted and folded over itself and defining parallel, spaced-apart layers for the support and screw-fastening attachment of other structural surfaces thereto, wherein the layers of each of said wings are discontinuous from each other and connected only by said socket.

* * * * *